US005461900A

United States Patent [19]

Gutierrez

[11] Patent Number: 5,461,900

[45] Date of Patent: Oct. 31, 1995

[54] VEHICLE BODY REPAIR TOOL

[75] Inventor: Marty R. Gutierrez, Sacramento, Calif.

[73] Assignee: Shamus, Sacramento, Calif.; a part interest

[21] Appl. No.: 363,991

[22] Filed: Dec. 27, 1994

Related U.S. Application Data

[63] Continuation-in-part of Ser. No. 27,840, Mar. 8, 1993, abandoned.

[51] Int. Cl.[6] ..... B21D 1/12

[52] U.S. Cl. ..... 72/479; 72/481; 72/705; 81/463

[58] Field of Search ..... 72/457, 477, 479, 72/480, 481, 705; 81/463

[56] References Cited

U.S. PATENT DOCUMENTS

| | | | |
|---|---|---|---|
| 1,471,605 | 10/1923 | Hoff et al. | 72/479 |
| 1,521,265 | 12/1924 | Anderson | 72/481 |
| 2,938,412 | 5/1960 | Walker | 72/477 |
| 3,327,516 | 6/1967 | Anderson | 72/479 |
| 3,519,087 | 7/1970 | Santi | 81/463 |
| 4,376,385 | 3/1983 | Davis | 72/479 |

*Primary Examiner*—Lowell A. Larson
*Attorney, Agent, or Firm*—Mark C. Jacobs

[57] ABSTRACT

A device for use in the repair of automobiles, trucks, farm equipment and other vehicles having sheet metal bodies capable of deformation from impact accidents, which device includes a main body portion having a first nestable solid section and a second tubular receiving section, the receiving section being constrictedly open at its proximal end being closed on its distal end by a closure which is threaded to receive a work head of varying configurations, each of which is interchangeable with the other for carrying out specific tasks or functions within a specific area of the vehicular body.

18 Claims, 3 Drawing Sheets

VEHICLE BODY REPAIR TOOL

This application is a continuation-in-part of U.S. Ser. No. 08/027,480 filed Mar. 8, 1993, and now abandoned.

BACKGROUND OF THE INVENTION

When automobiles and for that matter other vehicles, such as trucks, tractors, and vans, are involved in a collision, the bodies which are usually made of steel or aluminum often suffer significant damage. In many instances it becomes necessary to pry apart body sections, or body panels in order to permit refabrication and repair.

Hand tools are available for carrying out impact blows to bend, and shape the various structural sections. These hand tools resemble chisels. Thus, for ease and convenience, they will be referred to as chisels. They have an elongated shank connected to a head portion and are generally held in one hand while a hammer or mallet held in the other hand of the user delivers an impact blow to the proximal end of the shank of the chisel-like tool.

One of the problems encountered in their use is that in many instances there is insufficient room or space within which to maneuver to raise one's first arm to deliver a "heavy" blow to the chisel which is held in the user's second hand. Unfortunately high impact is what is needed to straighten bent structural components. Typical areas of confined working conditions include the interior of the trunk of a car, under the dashboard of any vehicle, or within the engine compartment of any vehicle for example when working on the fire wall. There is indeed therefore a need for a high impact providing tool that is capable of being used within a confined operating environment.

A search was carried out of the prior art and applicant has become aware of the following U.S. patent references:

| | | | |
|---|---|---|---|
| 0,280,995 | Armstrong | 2,629,985 | McDowell |
| 0,503,298 | Teufel | 2,754,585 | Green |
| 1,067,658 | Joyce | 3,769,682 | Carver |
| 1,229,732 | Erickson | 4,745,671 | Shannon |
| 1,665,109 | Nelson | 5,090,102 | Lovell |
| 1,958,329 | Beard | | |

None of these patents taken individually nor considered in combination render this invention old or obvious to one of ordinary skill in the art.

It is an object therefore of this invention to provide a new impact tool for use by vehicular body and fender repair persons on beams and other structural components.

It is another object to provide an impact tool usable in confined work spaces.

It is yet another object to provide an impact tool that features a weighted nestable impact driving member.

It is a further object to provide an impact tool with interchangeable heads to carry out different types of bending and straightening.

It is a yet further object to provide an impact tool for the vehicular body repair industry that replaces the hammer and a multiplicity of chisels and which includes built in safety features.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A device for use in the repair of structural components of automotive bodies of both unitized chassis construction and full frame bodies, deformed from impact accidents, which device includes a main body portion having a first nestable solid section and a second tubular receiving section for the first section. The nestable portion has a handle on its proximal end and an impact applying segment at its distal end. The receiving section is adapted to receive a blow from the nestable first section. The receiving section is also threaded on its distal end to receive different work heads of varying configurations, each of which is interchangeable with the other for carrying out specific tasks or functions on the vehicle sheet metal.

DESCRIPTION OF THE PREFERRED EMBODIMENT

Figure 1:
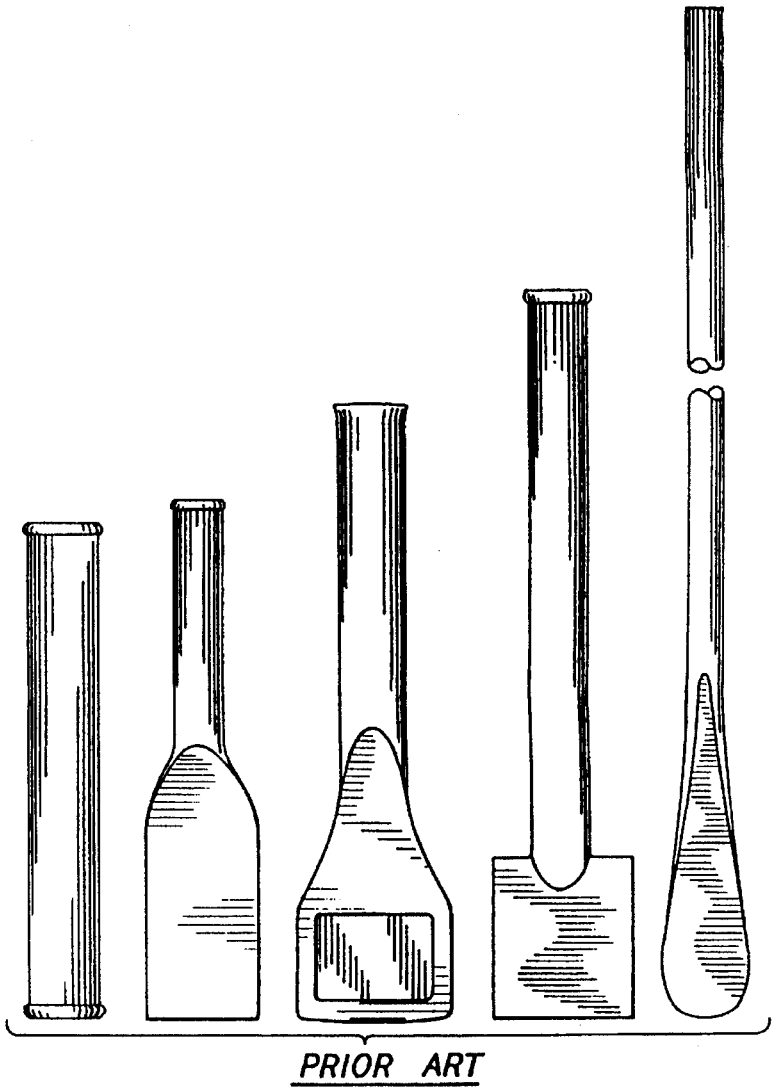
FIG. 1 is a front elevational view of a series of chisel-like tools all of which can be replaced by the device of this invention.

In FIG. 1, the prior art, there is depicted a plurality of metal impacting and bending tools as used in the automotive repair industry. All of these tools share a common construction. That is, they have a screw-in head which comprises a blade having a forward edge, that is dull or sharp, which blade is integral with a long generally round in cross section elongated shank, which shank serves as a handle, and which shank terminates in a flat end for receiving the impact blow. They bear such fanciful names as dolly on a spoon among others. All of these tools are used in conjunction with a maul or hammer which strikes a blow upon the end causing the rest of the tool to move forwardly to cut or bend metal.

Often these tools are used for prying and thus only the shank is moved in a lever-like fashion to apply force to the metal to be bent. Infrequently they are used for cutting through metal surfaces as would metal chisels. As can be seen from the large number of tools, as is understood by those operating in the art, the cost of this collection can be extremely high and the storage space requirements for them when not in use is quite voluminous.

Figure 2:
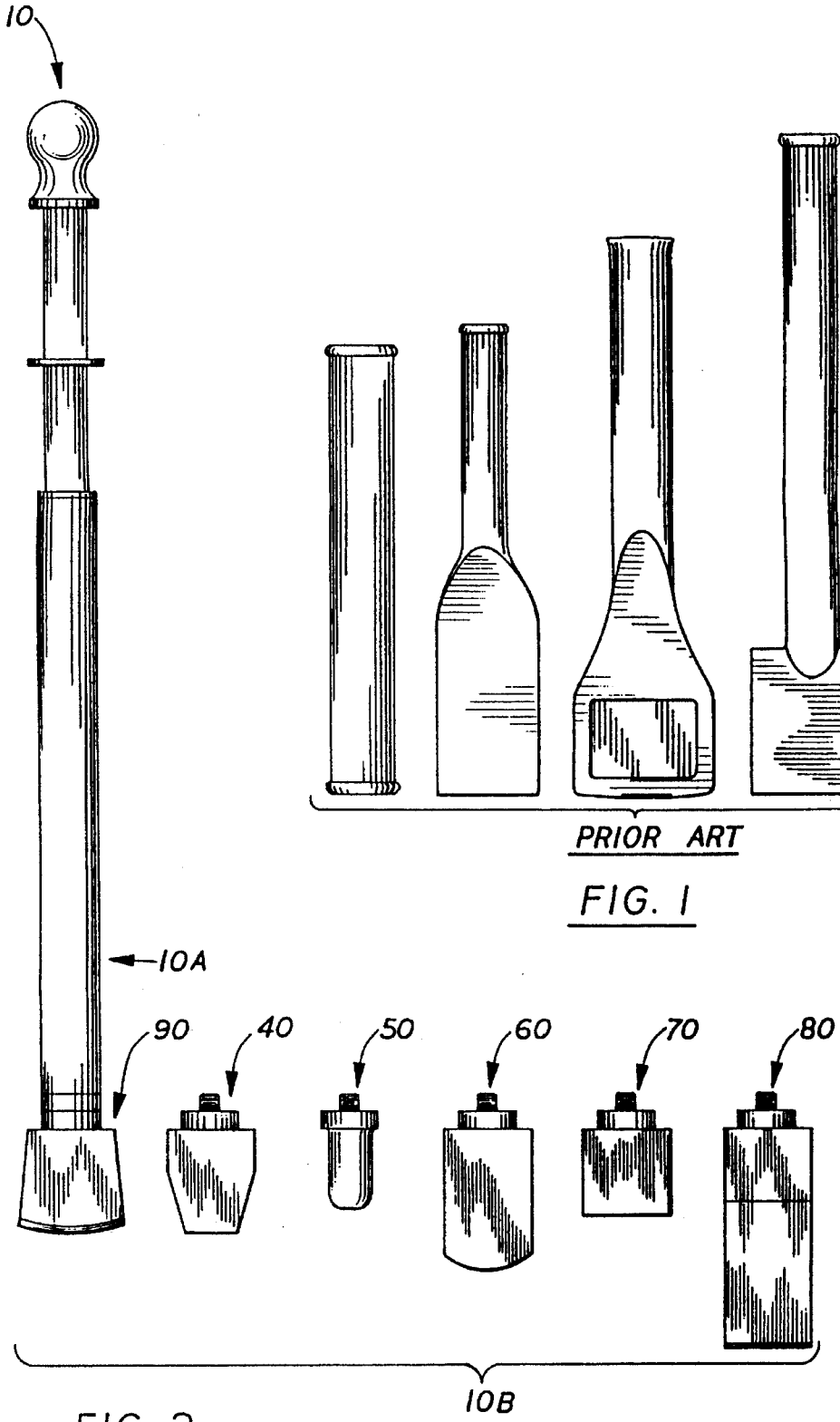
FIG. 2 is an elevational view of the device of this invention with one head in its operative position, and five other heads usable thereupon.

Thus the benefit to having the device of this invention as depicted in FIG. 2 is readily seen. In FIG. 2, there is shown the unitary tool of this invention and the collection of interchangeable impact application -metal bending- metal cutting heads usable therewith. Since a tool used for metal bending differs from one for cutting only by the degree of sharpness on the blade edge, and since metal impacting blades have a round or blunt forward edge to shape sheet metal, the term blade will be used generically as the descriptor for one element of the interchangeable heads.

In the discussion to follow, the term I.D. stands for internal diameter, while the term O.D. stands for external diameter. The thickness of a member or element, especially tubing is the difference between the O.D. and the I.D.

Figure 3:
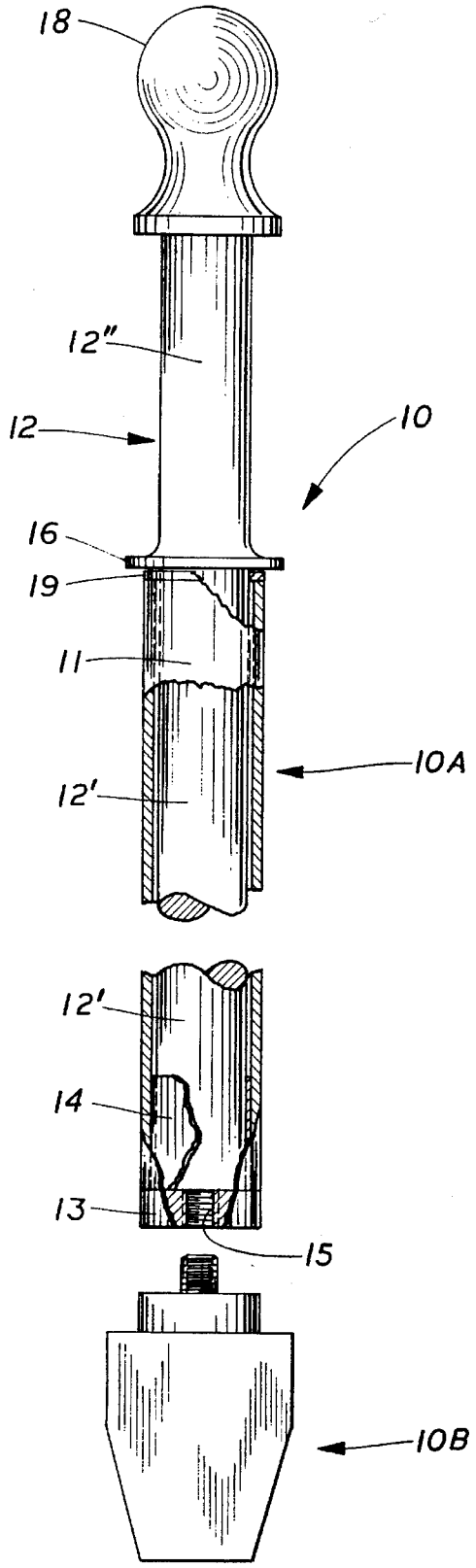
FIG. 3 is a close-up view, partially in cutaway of the device of this invention with one working head in juxtaposition for attachment to the main body of the device.

Thus the device 10 of this invention can be seen in FIG. 3 to comprise a tool body portion also referred to as the main body portion 10A and a plurality of differently configured tool heads 10B et. seq., each of which is mountable to the main body portion. The main body portion 10A comprises an elongated outer tube 11, preferably having a diameter of about 1,625 inches O.D. and 1,375 I.D. and of a length of between 16 and 17 inches, closed off at one end by a plug 13 that is butt against the tube and of a diameter equal to the external wall surface of the tube 11, i.e. preferably of 1,625 inches diameter O.D.; and, preferably welded or adhesed thereto. This plug has female threads 15 to threadingly receive the various heads to be described infra. The thickness of the plug may vary, preferably within the range from 0.5 to 1.0 inch with 0.75 inch being preferred. The external edge of plug 13 may be chamfered for ease of welding.

The other end of tube 11 is constrictedly open (discussed infra) and adapted to receive a nestable inner solid shaft 12, which inner shaft has an O.D. of 1.250 inches such that the ability to wobble sideways is minimized by the existence of only a ⅛ inch space between the shaft's outer wall and the tube's inner wall when the shaft is inserted into the tube.

Inner shaft 12 is circumscribed at one end, specifically the distal end to be inserted into tube 11 by a sleeve 14. The sleeve 14 which may be welded or adhesed or screwed to shaft 12 may vary preferably within the range from 1.0-inch to 2.0-inches in length, and preferably has an O.D. of 1,375-inches and an I.D. of about 1,250 inches. The segment 12' of the shaft 12 which lies within the confines of the sleeve 14 is designated the impact segment as will be discussed below.

After the shaft has the end sleeve attached thereto and the sleeve 14 is inserted into the tube 11, action may be taken to retain the shaft 12 within the tube 11. This is best achieved by placing constricting washer 19 over shaft 12 and into abutting position atop of tube 11. Washer 19 preferably has an O.D. of 1.625 inches and an I.D. of 1.25 inch. Thus, it is seen that the constricting washer 19, after being welded or otherwise secured to the open end of tube 11 serves to constrict the opening of tube 11 and to thereby prevent the sleeve 14 whose O.D. is 1,375 inches from passing therethrough, while permitting the balance of shaft 12 to indeed pass there through.

After the tube is constricted by the attachment of washer 19, the remaining elements may be attached to shaft 12. These include firstly the safety collar 16 which is placed strategically to prevent injury to the user's fingers from being squeezed slightly into the tube 11 during inward movement of shaft 12; and, secondly the knob or handle 18, both of which may be welded or adhesed into position.

Portion 12" of shaft 12 which lies between the handle 18 and collar 16 when the shaft 12 is fully inserted into tube 11 may be rubber coated as Neoprene polymerized (2-chloro-1,3-butadiene) to ensure easy gripability in temperatures. Collar 16 and handle 18 may be similarly overcoated. Optionally, but preferably the outer tube 11 may also be overcoated with Neoprene®.

Portion 10B as depicted in FIG. 2 is of no particular criticality and serves merely to be illustrative of the various tool heads engageable with the tool body, 10A.

Figure 4:
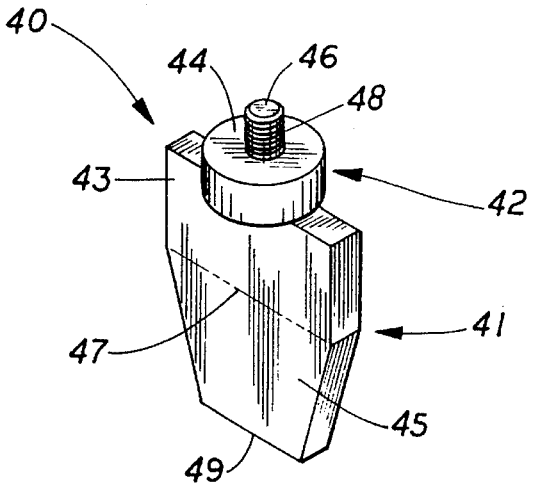
FIGS. 4 and 5 are perspective views of two other work heads suitable for use with the main body of this device each of which heads is different from the one shown in FIG. 3.

The discussion now turns to FIG. 4 where there is depicted the first of the various threadingly engageable tool heads for use with the tool body of this invention. This tool head 40 which in the trade is referred to as an ARROW HEAD includes a metal working portion 41 and a mounting portion 42. The metal working portion 41 includes a first section 43 of a generally rectangular solid configuration dimensioned about ⅜th-inch thickness, 1.25-inch in elevation and about 2.5-inches wide. Integrally adjoined to this across the widest dimension along imaginary line 47 is a trapezoidal section 45's first base of about 2.5 inches in width. The distant base of the trapezoidal section is 1.75 inches from the junction of the two sections and is about 1.5 inches wide across the flat blade edge.

On the opposite end of the first section 43 preferably welded thereto is the mount portion 42 comprising a cylindrical solid section 44 of about 1,625 inches in diameter and having a threaded mounting shaft 46 emanating therefrom. The threads are designated 48. This blunt tipped tool body is used for prying metal. By having the interposed cylindrical solid section between the main portion and threaded shaft, strain is removed from the threaded shaft, permitting it to stay in position after the threaded engagement thereof with the receiving section. Also the energy of impact is better able to spread out over the entire area of the main portion rather than being concentrated in the middle if only a shaft were present. For these reasons, the same mount portion is used in all of the tool heads to be discussed herein.

Figure 5:
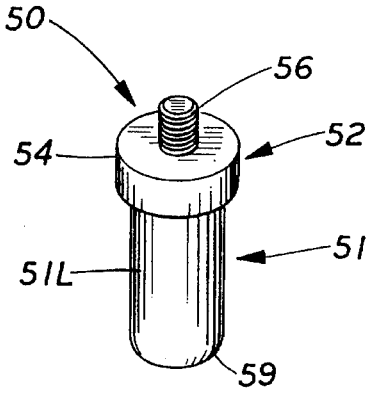

In FIG. 5 there is seen a second tool head, 50, which in the trade is referred to as a BULLET HEAD. This tool body 50 includes a main portion 51 comprising a cylinder of about 1.25 inches in diameter and about 2,250-inches long. The blade edge 59 is flat in the center and is radiused to the length of the cylinder 51L. At the end of the body opposite the blade, and secured thereto as by welding is the mount portion 52. This portion 52 which is identical in configuration to mount portion 42 comprises a short cylindrical section 54 of about 1,625-inches diameter, having a centrally disposed threaded shaft 56 upstanding therefrom. This tool body is used for forming metallic curves.

Figure 6:
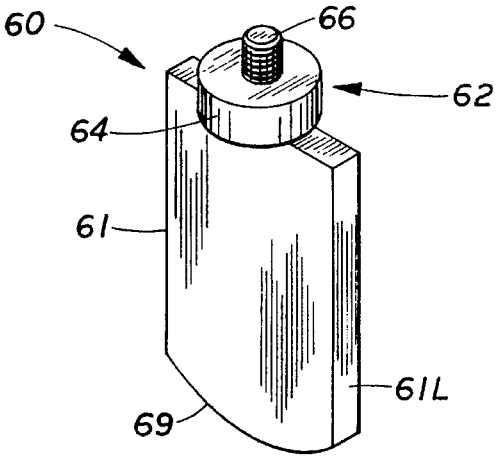
FIGS. 6 and 7 are perspective views of two further work heads of functionality different from those heads shown in other figures of this patent application.

In FIG. 6 there is shown a third tool head 60, designated a BEAVER TAIL and which is suitable for use with the main body of the tool of this invention. This tool head comprises a body portion 61 and a mounting portion 62. The body portion is a generally rectangular solid 61 about 0.5-inch thick, about 4-inches long and about 2.5-inches wide. The blade edge 69 is uniformly curved from one side edge 61L to the other side edge. The mount portion 62 is identical in configuration to mount portion 42, and comprises a short cylindrical section 64 of about 1.625-inches diameter, having a centrally disposed threaded shaft 66 upstanding therefrom. This tool body is used to reshape metal body panels.

Figure 7:
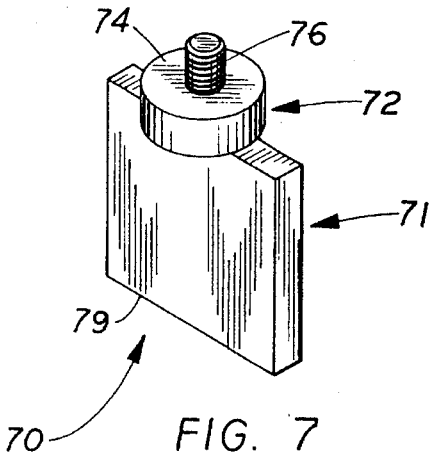
Figure 8:
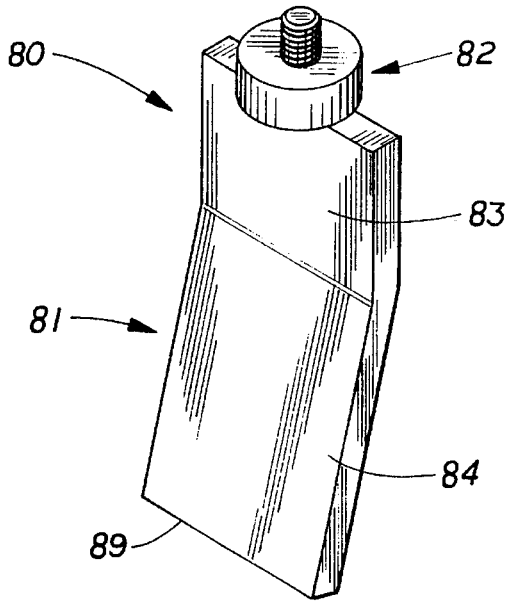
FIGS. 8 and 9 are perspective views of two further heads suitable for use with the main body of this device.

In FIG. 7 there is shown yet another tool head 70, designated the BLOCK. This tool head comprises a body portion 71 which is a square solid main section about 0,375-inch thick and about 2.5 inches in elevation and width. The blade edge 79 is blunt and comprises the distal edge of the square. Here the mount portion 72 is similar to the previously discussed mount portions and as such only minimal discussion need be devoted to it. Here the cylinder is designated 74 and the upstanding threaded shaft is 76. This tool body is used to reconstruct solid square edges of metal body panels or unitized structural components.

The discussion now turns to the 8th and 9th FIGS. Shown here are work heads 80 and 90 designated within the trade as an OFFSET and a DUCKBILL, which are both used to aid in the reconstruction of a beams and other structural members to their former configuration by prying and bending of the metal therewith.

In tool head 80 the body 81 is generally rectangular in a front planar view approximately 2.5-inches wide by 6.25-inches in elevation, but with a bend of about 15 degrees at a distance of about 30% up from the junction with the mount portion 82, i.e., along line 88 thereby diving body portion 81 into a first section 83 axially aligned with the mount portion and an offset larger section 84. The work edge of the tool head 89 does not taper to a knife edge and is thus of a thickness equal to about the thickness of the remainder of the work head, i.e., about 0,375 inches.

Since the mount portion 82 is intended to be the same as those mount heads previously discussed, it is seen to be of similar dimensions to make for easy interchangeability as may be needed.

Figure 9:
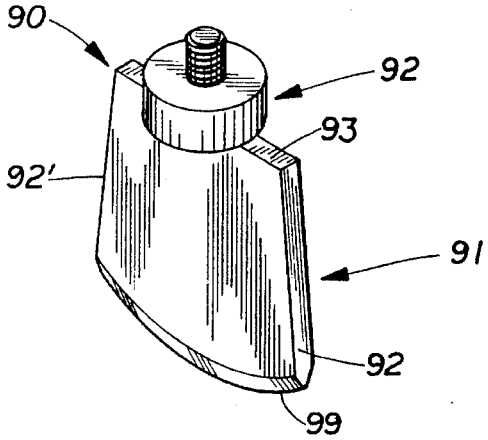

In tool head 90 as seen in FIG. 9, the tool body 91 is generally rectangular in a cross section normal to the mount shaft's elongation. As seen in elevation or perspectively, the body 91 has a horizontal base 93 about 2-½ inches wide, slightly diverging sides 92, 92' and a slightly arcuate curved front or forward edge 99, the most forward point on the curvature being equidistant laterally from each of the diverging sides. Typically the span across the arcuate front edge of the blade 99 is about 3 inches. The front edge preferably tapers along the curvature to a dull pointed edge.

USE OF THE DEVICE OF THIS INVENTION

Figure 10:
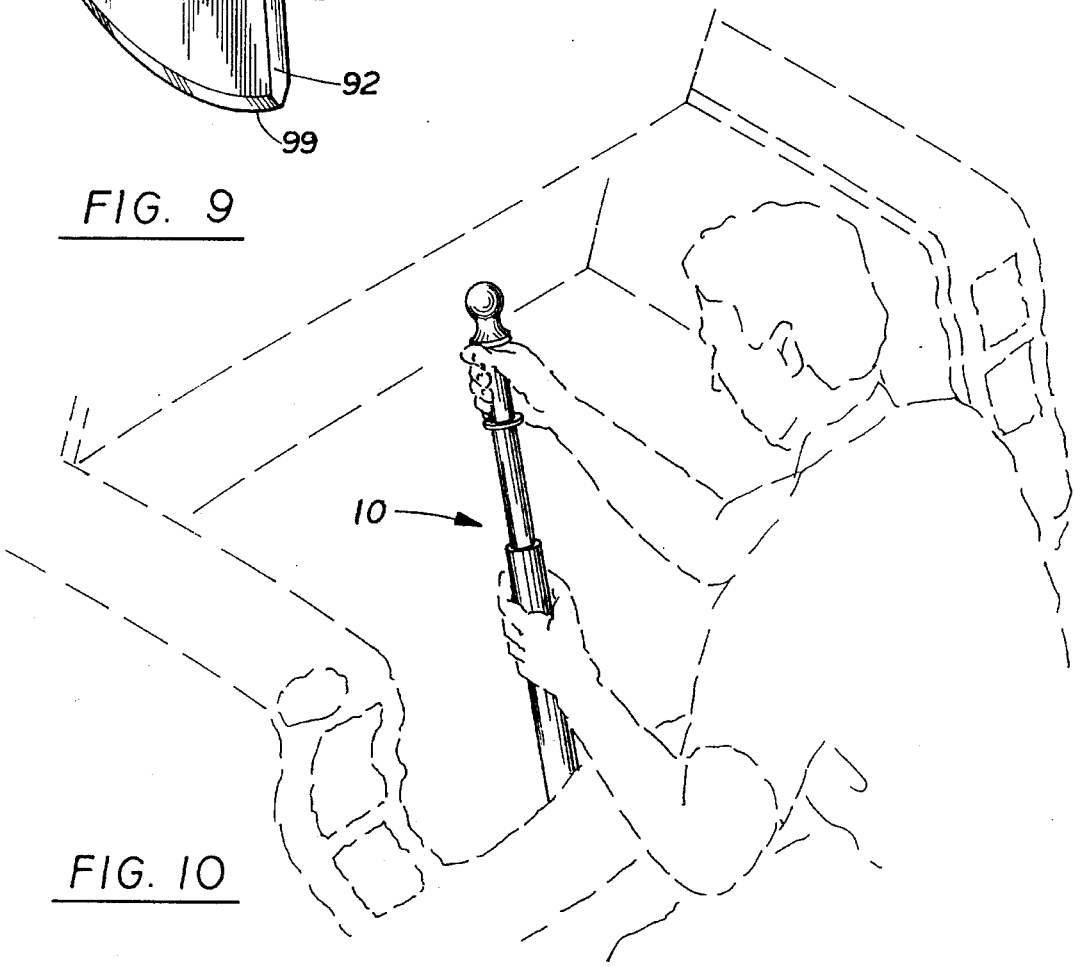
FIG. 10 is a perspective view of an operator using the device of this invention within the confines of a trunk of a damaged auto.

In FIG. 10 there is seen a repairman using the tool (device) of this invention within the confines of the trunk area of an auto. The tool head is placed in contact with the metal to be worked upon, i.e., the work piece. While holding outer tube 11 in one hand, the hand of choice, the operator grips the handle 18 above the collar 16 and withdraws the inner shaft 12 a distance up to the maximum possible. The inclination of the device 10 viz a viz the work piece is checked. The operator then pushes the shaft 12 into the tube to deliver the energy of the motion to the impact of the shaft 12, i.e., the distal segment of the shaft upon the plug 13, which energy is transferred to the mount portion of the tool body and the body portion thereof to move the metal in the manner desired, be it prying opening, straightening, or cutting.

The big advantages to the device of this invention are many. First is the ability to work within confined areas. There is no need to raise the arm to strike a blow as with a hammer to achieve the energy needed to realign structural components as with prior art tools. Second, is the avoidance of common injuries due to improper swings of a hammer or maul, especially in close quarters, where a full arm swing is impossible. Third is the safety factor, in that there is no risk of a misdelivered blow to the hand or the vehicle's sheet metal and other technical components should the hammer blow miss the chisel. Fourth is the reduction in cost relative to a series of individual tools. Fifth, is the storage space reduction compared to a closet full of tools. Sixth, is the fact that the unique design employed here with a mount portion on the work head provides for sufficient rigidity to permit the same level of skilled effort to be achieved from one interchangeable head tool as from a series of separate tools. Seventh, because of the design, the tool is capable of converting almost 100% of the kinetic energy to mechanical energy at point of impact consistently with each driven blow as compared with the prior art.

The ability to work in close quarters can not be over emphasized, both from a safety point of view and an ease of operating point of view. Work can proceed quicker when one has peace of mind, especially when working in confined areas of a vehicle such as under the hood and within the trunk. This is especially true when all or part of the device is covered with Neoprene, which is an oil resistant rubber-like coating material which enhances gripability.

Text has not been devoted to how each of the work heads individually is used by the skilled artisan, since each of these heads exist on full integrated tools with attached handles. The use of the prior art versions of these work heads is well understood by those skilled in the art.

Throughout this application the term structural components has been employed. This term is intended to be inclusive, of such aspects of a vehicle as the frame rail of unitized body, the A (hinge) pillar, the B (lock) pillar, the C pillar, rocker panels both inner and outer, and the front header of roof both inner and outer among others. The tool of this invention is deemed to be too heavy duty for primary use on vehicular sheet metal without causing damage.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A device for use in confined environments for the repair of vehicles deformed from impact accidents, which device includes a main body portion and a series of tool heads, which device comprises:

a. said main body portion, comprising:

i. an elongated shaft nestable first section having distal and proximal ends with a handle being mounted at its proximal end, and a circumscribing sleeve spaced down from said handle disposed on said shaft, said sleeve defining with the distal end of said shaft a planar surface of an impact applying segment at the distal end thereof;

ii. a tubular receiving second section, adapted to receive the nestable first section therein, said second section being constrictedly open at its proximal end and closed off by an internally disposed plug at its distal end, said plug having a finite diameter and being threaded to threadedly engage any one of, b. said series of interchangeable tool heads being of varying configurations each of which comprises a metal working section and a mount section attached thereto, which mount section comprises a cylindrical solid member of a finite diameter, said member having a threaded mounting shaft emanating upwardly therefrom, which shaft is engageable with the second section of said main body portion, wherein the diameter of the plug closing off the second section of the main body portion is substantially the same as the diameter of the mount portion of the tool's cylindrical solid section, and said plug and said mount portion each having a planar surface in an abutting relationship, whereby upon utilization of said device, energy is transferred from said plug to said tool head through said cylindrical solid member.

2. In the device of claim 1 wherein at least part of the shaft of the first section of the main body portion is coated with Neoprene polymerized (2-chloro-1,3-butadiene).

3. In the device of claim 1 wherein the tool head is an arrow head.

4. In the device of claim 1 wherein the tool head is a bullet head.

5. In the device of claim 1 wherein the tool head is a beaver tail.

6. In the device of claim 1 wherein the tool head is an offset.

7. In the device of claim 1 wherein the tool head is a duckbill.

8. In the device of claim 1 wherein the handle is coated with Neoprene polymerized (2-chloro-1,3-butadiene).

9. In the device of claim 1 wherein the receiving section is coated with Neoprene polymerized (2-chloro-1,3-butadiene).

10. A device for use in confined environments for the repair of vehicles deformed from impact accidents, which device includes a main body portion and a series of tool heads, which device comprises:

a. said main body portion, having:

i. an elongated shaft nestable first section having distal and proximal ends with a handle being mounted at its proximal end, and a circumscribing sleeve spaced down from said handle mounted on said shaft, said sleeve defining with the distal end of said shaft a planar surface of an impact applying segment at the distal end thereof;

ii. a tubular receiving second section, adapted to receive the nestable first section therein, b. an injury precluding circumscribing collar disposed on the elongated shaft spaced down from said handle, said tubular second section being constrictedly open at its proximal end and closed off by an internally disposed plug at its distal end, said plug having a finite diameter and being threaded to threadedly engage any one of c. said series of interchangeable tool heads being of varying configurations each of which comprises a metal working section and a mount section attached thereto, which mount section comprises a cylindrical solid member having a threaded mounting shaft emanating upwardly therefrom, which shaft is engageable with the second section of said main body portion, wherein the diameter of the plug closing off the second section of the main body portion is substantially the same as the diameter of the cylindrical solid section of the mount portion of the tool, and said plug and said mount portion each having a planar surface in an abutting relationship, whereby upon utilization of said device, energy is transferred from said plug to said tool head through said cylindrical solid member.

11. In the device of claim 10 further including an injury precluding circumscribing collar disposed on the elongated shaft spaced down from said handle, and said handle is coated with Neoprene®.

12. In the device of claim 10 wherein at least one of the handle, the said shaft and the said tubular section are coated with Neoprene®.

13. In the device of claim 12 wherein at least two of the handle, the said shaft and the said tubular section are coated with Neoprene®.

14. In the device of claim 10 wherein the tool head is an arrow head.

15. In the device of claim 10 wherein the tool head is a bullet head.

16. In the device of claim 10 wherein the tool head is a beaver tail.

17. In the device of claim 10 wherein the tool head is an offset.

18. In the device of claim 10 wherein the tool head is a duckbill.

* * * * *